US008684510B2

(12) United States Patent
Miyamoto et al.

(10) Patent No.: US 8,684,510 B2
(45) Date of Patent: Apr. 1, 2014

(54) DRYING DEVICE AND RECORDING DEVICE EQUIPPED WITH DRYING DEVICE

(75) Inventors: Kazuko Miyamoto, Nagano (JP); Satoru Shiohara, Nagano (JP); Hiroshi Mikyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 13/040,578

(22) Filed: Mar. 4, 2011

(65) Prior Publication Data

US 2011/0228025 A1 Sep. 22, 2011

(30) Foreign Application Priority Data

Mar. 17, 2010 (JP) ..... 2010-060280

(51) Int. Cl.
*B41J 2/01* (2006.01)

(52) U.S. Cl.
USPC ..... 347/102; 347/101

(58) Field of Classification Search
USPC ..... 347/102, 17, 101
IPC ..... B41J 2/01
See application file for complete search history.

(56) References Cited

U.S. PATENT DOCUMENTS

| | | | | |
|---|---|---|---|---|
| 4,103,434 | A * | 8/1978 | Walker | 34/114 |
| 4,462,868 | A * | 7/1984 | Oubridge et al. | 162/280 |
| 5,020,244 | A * | 6/1991 | Smith | 34/633 |
| 5,317,127 | A * | 5/1994 | Brewster et al. | 219/388 |
| 5,864,352 | A * | 1/1999 | Aoki et al. | 347/102 |
| 6,354,015 | B1 * | 3/2002 | Ogasawara et al. | 34/60 |
| 6,439,712 | B1 * | 8/2002 | Mizutani et al. | 347/102 |
| 6,854,842 | B2 * | 2/2005 | Martin et al. | 347/102 |
| 2007/0019050 | A1 * | 1/2007 | Lim | 347/102 |
| 2009/0033731 | A1 * | 2/2009 | Yamamoto et al. | 347/102 |
| 2009/0033733 | A1 * | 2/2009 | Higashimoto et al. | 347/104 |
| 2009/0085997 | A1 * | 4/2009 | Sakamoto | 347/102 |
| 2010/0180784 | A1 * | 7/2010 | Shiohara | 101/424.1 |

FOREIGN PATENT DOCUMENTS

| | | | |
|---|---|---|---|
| JP | 03-182353 | A | 8/1991 |
| JP | 05-220949 | A | 8/1993 |
| JP | 10-193580 | A | 7/1998 |
| JP | 11-170495 | A | 6/1999 |
| JP | 2003-341042 | A | 12/2003 |
| JP | 2009-045861 | A | 3/2009 |

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

A drying device includes a drying unit configured to carry out a drying process on a recording medium by blowing heated air from a discharge port formed at a location partway along the conveyance path of the recording medium as the medium is conveyed from the upstream side to the downstream side in the conveyance direction. A drying zone is disposed on the downstream side of the drying unit in the conveyance direction over the front face of the recording medium so that the air blown from the discharge port is retained in the drying zone. An upper surface of the drying zone is defined by an extended surface portion of an outer surface of a housing of the drying unit, the extended surface portion extending from the discharge port toward the downstream side in the conveyance direction to cover the conveyance path from above.

10 Claims, 1 Drawing Sheet

DRYING DEVICE AND RECORDING DEVICE EQUIPPED WITH DRYING DEVICE

CROSS-REFERENCE TO RELATED APPLICATIONS

This application claims priority to Japanese Patent Application No. 2010-060280 filed on Mar. 17, 2010. The entire disclosure of Japanese Patent Application No. 2010-060280 is hereby incorporated herein by reference.

BACKGROUND

1. Technical Field

The present invention relates to a drying device and to a recording device equipped with the drying device.

2. Related Art

Inkjet system recording devices are widely known in the field of recording devices that record information by depositing a liquid onto a recording medium. In recording devices of this kind, a drying device for drying the conveying recording medium on which the ink (liquid) has been deposited is disposed on the conveyance path of the recording medium (e.g., Japanese Laid-Open Patent Application Publication No. 2009-045861).

This type of drying device has an intake fan for drawing in air from the outside, a thermal heater for heating the drawn in air, a discharge port for blowing the heated air (warm air) onto the conveying recording medium, and a circulation space for guiding the warm air blown out from the discharge port back to the intake fan. By recirculating and blowing the warm air onto the recording medium in this way, the ink that has been deposited onto the recording medium is dried.

SUMMARY

According to the recording device of Japanese Laid-Open Patent Application Publication No. 2009-045861, the drying device is disposed at a location above the conveyance path of the recording medium, and a drying chamber disposed at a location downstream from the drying device on the recording medium conveyance path is defined by an upper defining wall and a lower defining wall disposed in opposition to one another to the upper and lower sides of the recording medium. Specifically, at a location to the downstream side of the drying device on the conveyance path of the recording medium, in the upper surface of the drying chamber (drying zone) which is adapted to collect to the upper side of the recording medium the dry air that has been blown from the discharge port of the drying device, the outer cover of the drying device and the upper defining wall composed of a metal component separate from the outer cover are arranged parallel to the conveyance direction in respective opposition to the upper face of conveying recording medium. Therefore, the dry air of the warm air blown from the discharge port of the drying device tends to leak out from the drying chamber through a gap that is present between the outer cover of the drying device and the upper defining wall of a metal component separate from the cover, thereby posing a risk of diminished drying efficiency in the drying chamber.

With the foregoing in view, it is an object of the present invention to provide a drying device that avoids diminished drying efficiency in the drying zone, and a recording device equipped with the drying device.

To attain the stated object, a drying device according to one aspect of the present invention includes a conveying unit, a drying unit and a drying zone. The conveying unit is configured to convey a recording medium, on which recording is performed by a liquid being deposited thereon, from an upstream side to a downstream side in a conveyance direction. The drying unit is configured to carry out a drying process on the recording medium by blowing heated air towards a front face of the recording medium, on which the liquid has been deposited, from a discharge port formed at a location facing the front face of the recording medium partway along a conveyance path of the recording medium conveyed by the conveying unit. The drying zone is disposed on the downstream side of the drying unit in the conveyance direction over the front face of the recording medium so that the air blown from the discharge port is retained in the drying zone. An upper surface of the drying zone is defined by an extended surface portion of an outer surface of a housing of the drying unit. The extended surface portion extends from the discharge port toward the downstream side in the conveyance direction to cover the conveyance path from above.

According to this configuration, the entirety of the upper surface of the drying zone comprises an extended surface portion which is part of the outer surface of the drying unit. Therefore, since no gap is present between the outside surface of the drying unit and other components at the top of the drying zone, leakage of warm air from the drying zone may be avoided, and diminished drying efficiency in the drying zone may be avoided.

In the drying device as described above, the conveying unit preferably includes pairs of roller members respectively disposed to the upstream side and the downstream side of the drying unit at locations partway along the conveyance path, and each of the pairs of the roller members being configured to rotate while one of the roller members contacts the front face of the recording medium. The drying zone is preferably formed between the pairs of roller members, the front face of the recording medium, and the extended surface portion of the drying unit.

According to this configuration, pairs of roller members disposed to the upstream side and the downstream side of the drying unit cover the zones at the upstream side and the downstream side along the conveyance path of the recording medium in the drying zone, and therefore escape of warm air along the conveyance path may be avoided. Consequently, diminished drying efficiency in the drying zone may be avoided to a greater extent.

In the drying device as described above, at a location adjacent to the drying zone, the drying unit preferably has an independent heat accumulation space which is separate from an air flow path section for warming air drawn into an interior of the drying unit from an outside and delivering warmed air to the discharge port.

According to this configuration, the temperature inside the drying zone can be raised through an insulating effect afforded by the heat accumulation space which is disposed adjacently to the drying zone. Consequently, the drying efficiency of the drying zone may be increased.

In the drying device as described above, the discharge port of the drying unit preferably opens towards the downstream side in the conveyance direction of the recording medium, and an inside wall surface of a flow path section which communicates with the discharge port in the air flow path section is sloped such that the upstream side in the conveyance direction of the recording medium is disposed above a surface in the drying unit facing the recording medium and where the discharge port is formed.

According to this configuration, the drying unit is able to blow warm air downwind over a large area of the recording paper conveying towards the downstream direction. Consequently, drying of the recording medium may take place more efficiently in the drying zone.

In the drying device as described above, the heat accumulation space of the drying unit is preferably disposed at a location further towards the downstream side of the discharge port in the conveyance direction of the recording medium.

According to this configuration, because the heat accumulation space can be warmed by warm air blown towards the recording medium, the temperature in the drying zone can be raised further. Consequently, drying efficiency in the drying zone may be increased.

To attain the stated object, a recording device according to another aspect of the present invention includes the drying device as described above and a recording head configured to carry out recording on the recording medium partway along the conveyance path of the recording medium that is being conveyed. The drying device is disposed at a location on a downstream side of the recording head in the conveyance path.

According to this configuration, in the recording device there are afforded working effects comparable to those of the drying device.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
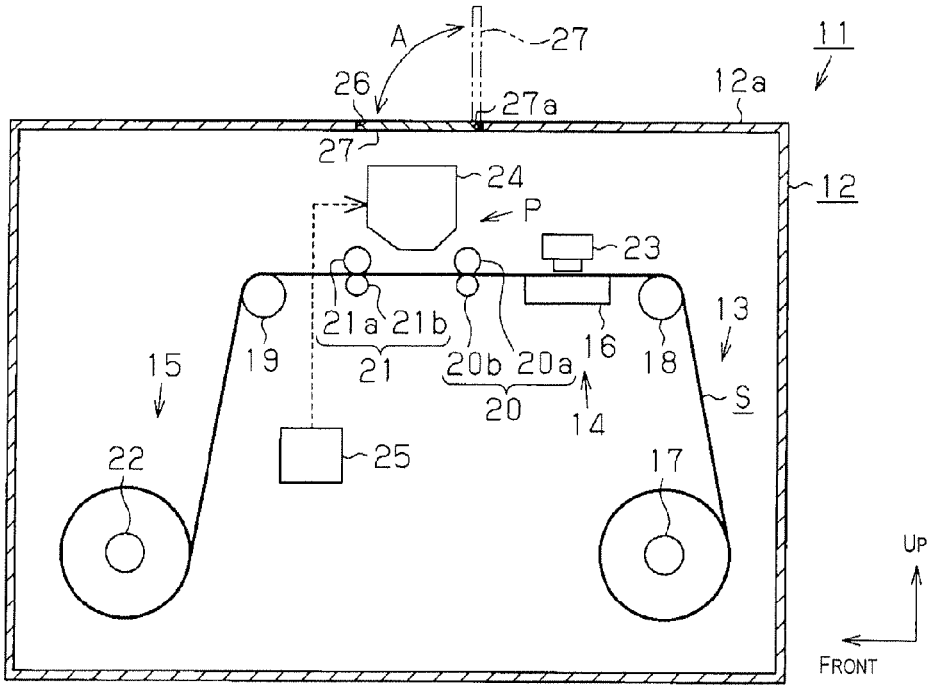
FIG. 1 is a simplified side view of a recording device according to an embodiment.

The present invention is described below as being embodied in one particular type of recording device, specifically, an inkjet system recording device (herein abbreviated to "recording device"), and in a drying device provided to the recording device, with reference to FIGS. 1 and 2. In the following description, unless specified otherwise, "longitudinal direction" and "vertical direction" refer to the "longitudinal direction" and "vertical direction" indicated by arrows in the drawings.

As shown in FIG. 1, the recording device 11 has a main unit case 12 substantially having the shape of a rectangular box forming the housing. Within the main unit case 12 are disposed a reel-out section 13 for reeling out a continuous paper sheet (recording medium) S of indefinite length, a recording section 14 for ejecting ink onto the continuous paper sheet being reeled out to effect recording, and a windup section 15 for winding up the continuous paper sheet S that has been printed in the recording section 14.

Specifically, within the main unit case 12, the reel-out section 13 is disposed at a location towards the back side which is also the upstream side in the conveyance direction of the continuous paper sheet S, and the windup section 15 is disposed at a location towards the front side which is also the downstream side. The recording section is disposed at a location partway along the conveyance path between the reel-out section 13 and the windup section 15. A platen 16 adapted to support the continuous paper sheet S is disposed at a location towards the back side from the recording section 14.

As shown in FIG. 1, a reel shaft 17 extending in the lateral direction (the direction orthogonal to the plane of the page) is rotatably disposed in the reel-out section 13. The continuous paper sheet S, which has been pre-wound in roll form onto the reel shaft 17, is supported in a manner capable of rotation in unison with the reel shaft 17. Specifically, the continuous paper sheet S is reeled out from the reel shaft 17 through rotation of the reel shaft 17 and is conveyed towards the downstream side in the conveyance direction. At a location diagonally to the front side of the reel-out section 13 there is provided a first pickup roller 18 which is rotatably disposed extending the lateral direction and adapted to rotatably engage the continuous paper sheet S reeled out from the reel shaft 17 and guide it towards the recording section 14. The continuous paper sheet S reeled out from the reel shaft 17 is rotatably engaged from below by the first pickup roller 18, whereby the conveyance direction of the continuous paper sheet S is changed to the horizontal direction.

To the front side of the platen 16 a second pickup roller 19 which faces towards the first pickup roller 18 in the longitudinal direction to the back side (upstream side) thereof with the platen 16 therebetween is disposed extending in the lateral direction parallel to the first pickup roller 18. The first pickup roller 18 and the second pickup roller 19 are adjusted so that the apical portion of their respective peripheral surfaces are respectively positioned at the same height as a support surface constituted by the upper surface of the platen 16. Therefore, the continuous paper sheet S whose conveyance direction has been converted to the horizontal direction by the first pickup roller 18 advances towards the front side, i.e., the downstream side, while in sliding contact with the support face of the platen 19; and is then rotatably engaged from the top front of the second pickup roller 19, whereby the conveyance direction of the continuous paper sheet S is converted from the horizontal direction to frontward and diagonally downward direction.

At a location to the front side of the platen 16 and the back side of the second pickup roller 19 there are disposed pairs of feed rollers 20, 21 with a gap therebetween. The feed roller pairs 20, 21 are respectively composed of drive rollers 20*a*, 21*a* extending in the lateral direction and provided as roller members for contacting the printed surface of the continuous paper sheet S, and follower rollers 20*b*, 21*b* for contacting the other surface of the continuous paper sheet S. With the continuous paper sheet S nipped between the drive rollers 20*a*, 21*a* and the follower rollers 20*b*, 21*b*, the continuous paper sheet S is conveyed as a result of following rotation of the follower rollers 20*b*, 21*b*, driven by driving rotation of the drive rollers 20*a*, 21*a*.

The windup section 15 is disposed to the front side of the second pickup roller 19, and a windup shaft 22 is rotatably disposed at a location below the windup section 15 (diagonally below the second pickup roller 19). The leading end of the continuous paper sheet S, which is the lower end in the conveyance direction, is reeled onto the windup shaft 22. In the above manner, the reel-out section 13, the recording section 14, the windup section 15, and the feed roller pairs 20, 21 constitute the conveying mechanism for conveying the continuous paper sheet S recording medium along the conveyance path.

As shown in FIG. 1, at a location facing the platen 16 to the upper side of the recording section 14 there is disposed a recording head 23 of a line head type. The lower face of the recording head 23 constitutes a horizontal nozzle formation face onto which open a plurality of nozzles (not shown) for ejecting ink. The recording head 23 extends in the horizontal direction in a direction orthogonal to the conveyance direction of the continuous paper sheet S, and the length thereof in the lengthwise direction is equivalent to the maximum width of the continuous paper sheet S. The recording head 23 is adapted to effect printing by ejecting ink onto a recording area of the conveying continuous paper sheet S at a location partway along the conveyance path.

Additionally, at a location to the front side of the recording head 23 to the downstream side of the recording section 14 in the conveyance direction of the continuous paper sheet S there is disposed an attachment section P for detachably attaching a heater unit 24 provided as drying unit for carrying out a drying process on the continuous paper sheet S onto which the ink ejected from the recording head 23 has been deposited. A controller 25 is electrically connected to the heater unit 24, and the temperature, etc., of the heater unit 24 is controlled by the controller 25.

As shown in FIG. 1, on the upper surface 12*a* of the main unit case 12 at a location corresponding to that of the attachment section P for the heater unit 24, an opening portion 26 is formed, and a cover body 27 adapted to cover the opening portion 26 is disposed. The cover body 27 is rotatably supported on the main unit case 12 via a rotating shaft 27*a* disposed to the back side of the cover body 27, so that the cover body is displaceable between a covered position covering the opening portion 26 (the position indicated by the solid lines in FIG. 1) and an uncovered position with the opening portion 26 open (the position indicated by the double-dot broken lines in FIG. 1). That is, the cover member 27 is designed to rotate in the direction indicated by arrow A in FIG. 1.

Figure 2:
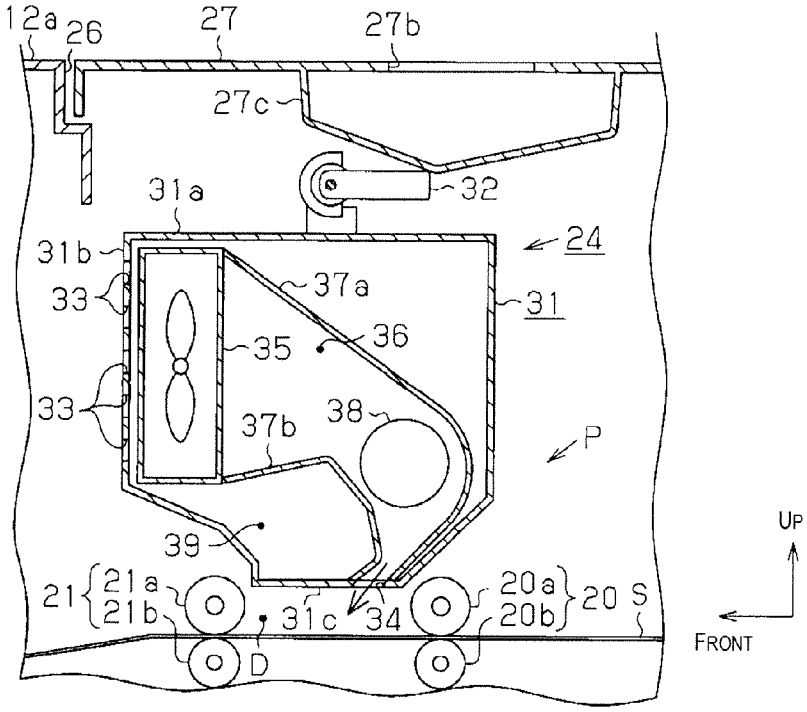
FIG. 2 is an enlarged simplified cross sectional view of the recording device.

An opening 27*b* (see FIG. 2) permitting insertion of a fingertip is disposed at the approximate center of the cover body 27, and an infolding portion 27*c* of a substantially "U"-shaped profile viewed in cross section is formed on the main unit case 12 inside-facing surface of the cover member 27 so as to cover the opening 27*b* (see FIG. 2). Specifically, this opening 27*b* and the infolding portion 27*c* serve as means permitting the user to insert a fingertip to rotationally displace the cover body 27. By displacing the cover body 27 from the covered position to the uncovered position, the heater unit 24 can be attached to or detached from the attachment section P inside the main unit case 12 through the open opening portion 26.

Next, the heater unit 24 is described with reference to FIG. 2.

The heater unit 24, which is disposed at a location between the feed roller pairs 20, 21 to the front side (downstream side) of the recording head 23, extends in the horizontal direction in a direction orthogonal to the conveyance direction of the continuous paper sheet S, and has a length in the lengthwise direction equivalent to the maximum width of the continuous paper sheet S. As shown in FIG. 2, the heater unit 24 has a cover 31 of substantially cuboid shape formed of a resin such as modified polyphenylene ether. The outside surface of this cover 31 constitutes the housing of the heater unit 24. On the upper panel 31*a* of the cover 31 located on the upper surface side of the heater unit 24 in the installation direction there is disposed a plate-shaped grip portion 32 of a substantially "U"-shaped profile. Gripping this grip portion 32 and lifting upward allows the heater unit 24 to be attached to and detached from the attachment section P inside the main body case 12. The front panel 31*b* at the front side (downstream side) of the cover 31 is perforated by a plurality of air intake ports 33 (five are illustrated in FIG. 2) in a regular arrangement at prescribed spacing in the plumb vertical direction. Additionally, at a location on the back side (upstream side) of the lower panel 31*c* on the lower side of the cover 31 there is formed a discharge port 34 of substantially rectangular shape along the lengthwise direction of the cover 31, and opening towards the downstream side on the conveyance direction of the continuous paper sheet S.

At a location facing the air intake ports 33 in the interior of the cover 31 there are disposed a plurality of fans 35 for drawing air outside the cover 31 into the interior through the air intake ports 33. Also, an air flow path section 36 for guiding air drawn in through the air intake ports 33 to the discharge port 34 is disposed in the interior of the cover 31. Specifically, inside wall surfaces 37*a*, 37*b* having a substantially "J"-shaped profile are disposed inside the cover 31, with the edge portions at the front side of the inside wall surfaces 37*a*, 37*b* respectively linked to the upper faces and the lower faces of the fans 35, and with the other edge portions at the back side respectively linked to the back side portion at the back side and the front side portion at the front side in the discharge port 34. The two side panels of the cover (not shown) and the inside wall surfaces 37*a*, 37*b* define the air flow path section 36 through which air flows inside the cover 31.

A heater 38 is disposed at a location at the top of the back side (upstream side) of the discharge port 34 at the downstream side of the blowing direction of the fans 35 inside the air flow path section 36. The inside wall surfaces 37*a*, 37*b* in the sections thereof that constitute the air flow path section 36 below the heater 38 are sloped such that the back side (upstream side) rises upward from the back side (upstream side) towards the front side (downstream side). Therefore, the design of the heater unit 24 is such that by causing the fans 35 to rotate while the heater 38 radiates heat, the air drawn in through the air intake ports 33 is heated by the heater 38, and the heated air (warm air) is then blown against the continuous paper sheet S from the upstream side towards the downstream side in the conveyance direction.

As shown in FIG. 2, with the heater unit 24 installed correctly in the attachment section P, the upper part of the recording zone of the continuous paper sheet S between the feed roller pairs 20, 21 is covered from above by the lower panel 31*c* of the cover 31 in the heater unit 24. The front face of the continuous paper sheet S, the lower panel 31*c* of the cover 31, and the feed roller pairs 20, 21 thereby define a drying zone D in which the ink on the continuous paper sheet S is dried by the accumulated warm air that has been blown towards the continuous paper sheet S from the discharge port 34 of the heater unit 24. Specifically, the upper surface of the drying zone D is constituted by the lower panel 31*c* of the cover 31, and zones at the upstream side and the downstream side in the conveyance direction of the continuous paper sheet S in the drying zone D are covered by the drive rollers 20*a*, 21*a* which contact the front face of the continuous paper sheet S. At this point, the lower panel 31*c* of the cover 31 in the heater unit 24 functions as an extended surface portion that defines the discharge port 34 and that extends towards the downstream side in the conveyance direction of the continuous paper sheet S from the discharge port 34 and covers the conveyance path from above. According to the present embodiment, the drying device is composed of the conveying unit which include the reel-out section 13, the recording section 14, the feed roller pairs 20, 21, and the windup section 15; and the drying zone D for carrying out drying of the conveying continuous paper sheet S by the heater unit 24.

In the interior of the cover 31 in the heater unit 24, the front panel 31*b*, the lower panel 31*c*, the two side panels, and the inside wall surface 37*b* define an independent heat accumulation space 39 disposed to the front side (downstream side) of the air flow path section 36. Because this heat accumulation space 39 is disposed adjacently to the air flow path section 36 and the drying zone D, air inside the heat accumulation space 39 is warmed by the warm air that has been blown towards the downstream side from the heater 38 and the discharge port 34 inside the heat accumulation space 39 and that has collected in the drying zone D.

The heater unit 24 is designed such that the lower surface 31*c* of the cover 31 forms a flat face, and the center of gravity is disposed at the center of the heater unit 24. Therefore, when the heater unit 24 is uninstalled from the attachment section P, the uninstalled heater unit 24 can be placed directly on the floor or desktop in the same orientation as when installed.

The description turns next to operation of the recording device 11 of the configuration described above, with particular focus upon the drying process of the continuous paper sheet S inside the drying zone D.

When, for example, the recording process is initiated in the recording device 11, the fans 35 are actuated while the heater 38 of the heater unit 24 is radiating heat so that warm air begins to blow, while the continuous paper sheet S is reeled out from the reel-out section 13 and advances from the upstream side to the downstream side in the conveyance direction. Next, the continuous paper sheet S advances to the recording section 14, and in the recording section 14 ink is ejected onto the continuous paper sheet S from the recording head 23, against the front face of the continuous paper sheet S sliding over the platen 16. The continuous paper sheet S on which the ink has been deposited then advances further and passes through the drying zone D interior. In the drying zone D interior, warm air blown towards the downstream side from the discharge port 34 of the heater unit 24 which is disposed at the upstream side is blown onto the front face of the conveying continuous paper sheet S.

In the drying zone D, the upper portion (upper surface) and the side faces at the upstream side and the downstream side along the conveyance direction of the continuous paper sheet S are covered respectively by the lower surface 31*c* of the heater unit 24 and by the drive rollers 20*a*, 21*a*, whereby the warm air blown from the discharge port 34 collects efficiently inside the drying zone D. By blowing the warm air from the upstream side towards the downstream side inside the drying zone D, the warm air is blown over a large area and for a prolonged period of time onto the continuous paper sheet S which is conveying towards the downstream side, thereby accelerating drying of ink deposited onto the front face of the continuous paper sheet S. Further, because the heat accumulation space 39 is disposed in the upper portion inside the drying zone D, the inside of the drying zone D is maintained at high temperature by the warm air layer inside the heat accumulation space 39.

The continuous paper sheet S, with the ink on the front face thereof now being dry, advances to the windup section 15 where it is wound up by the windup shaft 22.

The embodiment described above affords effects such as the following.

(1) Because the entire upper portion of the drying zone D is constituted by the lower surface 31*c* of the cover 31 in the heater unit 24, there is no gap between the lower surface 31*c* of the cover 31 and other components in the upper portion of the drying zone D. Consequently, leakage of warm air to outside the drying zone D may be avoided, and diminished drying efficiency in the drying zone may be avoided.

(2) The drive rollers 20*a*, 21*a* of the feed roller pairs 20, 21 which are respectively disposed to the upstream side and the downstream side of the heater unit 24 cover the zones at the upstream side and the downstream side of the drying zone D along the conveyance path of the continuous paper sheet S, whereby escape of warm air along the conveyance path may be avoided. Consequently, diminished drying efficiency in the drying zone may be avoided to a greater extent.

(3) The temperature inside the drying zone can be raised through an insulating effect afforded by the heat accumulation space 39 which is disposed adjacently to the drying zone D. Consequently, the drying efficiency of the drying zone may be increased.

(4) The heater unit 24 is able to blow warm air downwind over a large area of the continuous paper sheet S conveying towards the downstream direction. Consequently, drying of the continuous paper sheet S may take place more efficiently in the drying zone D.

(5) Because the heat accumulation space 39 can be warmed by warm air blown towards the continuous paper sheet S, the temperature in the drying zone D can be raised further. Consequently, drying efficiency in the drying zone D may be increased.

Modifications such as the following may be made to the embodiment set forth above.

The recording medium is not limited to a continuous paper sheet S, and instead may be a continuous film or the like. The continuous paper sheet S may be cut to prescribed lengths in the course of advance. The recording medium is not limited to one of indefinite length, and may instead be paper cut to prescribed dimensions.

The heater unit 24 is not limited to a detachable arrangement, and may be fixedly disposed inside the main unit case 12 of the recording device 11.

The recording head 23 is not limited to line head type, and, optionally, recording may be carried out by moving a short-dimensioned recording head in a direction intersecting the conveyance direction of the continuous paper sheet S to record over the entire width of the continuous paper sheet S.

Optionally, the heat accumulation space 39 may be disposed to the upstream side of the discharge port 34, or to both the upstream side and the downstream side of the discharge port 34. The heat accumulation space 39 need not be disposed at a location adjacent to the drying zone D.

The direction of blowing the warm air is not limited to a diagonal direction towards the downstream end in the conveyance direction of the continuous paper sheet S, and, optionally, may be a direction oriented in the plumb vertical direction with respect to the continuous paper sheet S.

The drive rollers 20*a*, 21*a* are not limited to members of elongated dimensions, and may be split into multiple sections in the width direction. The follower rollers 20*b*, 21*b* may be omitted. The drive rollers 20*a*, 21*a* need not be disposed in the drying zone D.

Whereas in the description of the preceding embodiment the recording device is embodied as an inkjet system recording device 11, recording devices that eject or expel liquids besides ink may be employed as well. Adaptation for use in liquid ejecting devices of various kinds equipped with liquid ejecting heads for expelling minutely small droplets is also possible. Herein, "drop" refers to a state of a liquid when ejected from the recording device, and includes granular shape, teardrop shape, or filiform shape having a tail. "Liquid" may refer to any material able to be ejected from a recording device. For example, any materials in which the substance is in the liquid phase are acceptable, such as liquids of high or low viscosity, sols, gel water, and materials in other flowable states such as inorganic solvents, organic solvents, solutions, liquid resins, liquid metals (molten metals); nor are liquids limited to those containing a single state of matter, and may include those in which particles of functional materials composed of solids, such as pigments, metal powders, or the like are dissolved, dispersed, or mixed into a medium as well.

Ink, such as described in the preceding embodiment, or liquid crystals, may also be cited as typical examples of liquids. Here, the term ink is used to include ordinary water based inks and oil based inks, as well as various types of liquid compositions such as gel inks, hot-melt inks, and the like. Specific examples of recording devices are recording devices for ejecting liquids that contain materials such as electrode materials or coloring matter in dispersed or dissolved form, used for manufacturing, for example, liquid crystal displays, EL (electroluminescence) displays, surface emitting displays, color filters, and the like; recording devices for ejecting bioorganic compounds for use in biochip manufacture; recording devices for ejecting liquids as specimens used for precision pipettes; textile printing devices; microdispensers; or the like. Also employable are recording devices for pinpoint ejection of lubricants into precision instruments such as clocks or cameras; recording devices adapted to eject a solution of an ultraviolet-curing resin or other transparent resin onto substrates for the purpose of forming micro semi-spherical lenses (optical lenses) for use in as optical communication components etc.; or recording devices adapted to jet acidic or alkali etchant solutions for etching circuit boards, etc. The present invention may be implemented in any one of these types of recording device.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A drying device comprising:

a conveying unit configured to convey a recording medium, on which recording is performed by a liquid being deposited thereon, from an upstream side to a downstream side in a conveyance direction;

a drying unit configured to carry out a drying process on the recording medium by blowing heated air towards a front face of the recording medium, on which the liquid has been deposited, from a discharge port formed at a location facing the front face of the recording medium partway along a conveyance path of the recording medium conveyed by the conveying unit; and a drying zone disposed on the downstream side of the drying unit in the conveyance direction over the front face of the recording medium so that the air blown from the discharge port is retained in the drying zone, an upper surface of the drying zone being defined by an extended surface portion of an outer surface of a housing of the drying unit, the extended surface portion forming a flat face and extending from the discharge port toward the downstream side in the conveyance direction to cover the conveyance path from above, the drying unit having an air flow path section for warming air drawn into an interior of the drying unit from an outside and delivering warmed air to the discharge port, and an independent heat accumulation space that is provided at a location adjacent to the drying zone and is separate from the air flow path section, the independent heat accumulation space having a bottom portion that faces the front face of the recording medium and is defined by the extended surface portion.

2. The drying device according to claim 1, wherein the conveying unit includes pairs of roller members respectively disposed to the upstream side and the downstream side of the drying unit at locations partway along the conveyance path, and each of the pairs of the roller members being configured to rotate while one of the roller members contacts the front face of the recording medium, the drying zone is formed between the pairs of roller members, the front face of the recording medium, and the extended surface portion of the drying unit.

3. The drying device according to claim 1, wherein the discharge port of the drying unit opens towards the downstream side in the conveyance direction of the recording medium, and an inside wall surface of a flow path section which communicates with the discharge port in the air flow path section is sloped such that the upstream side in the conveyance direction of the recording medium is disposed above a surface in the drying unit facing the recording medium and where the discharge port is formed.

4. The drying device according to claim 1, wherein the heat accumulation space of the drying unit is disposed at a location further towards the downstream side of the discharge port in the conveyance direction of the recording medium.

5. A recording device comprising:

the drying device according to claim 1; and a recording head configured to carry out recording on the recording medium partway along the conveyance path of the recording medium that is being conveyed, the drying device being disposed at a location on the downstream side of the recording head in the conveyance path.

6. A recording device comprising:

the drying device according to claim 2; and a recording head configured to carry out recording on the recording medium partway along the conveyance path of the recording medium that is being conveyed, the drying device being disposed at a location on the downstream side of the recording head in the conveyance path.

7. A recording device comprising:

the drying device according to claim 3; and a recording head configured to carry out recording on the recording medium partway along the conveyance path of the recording medium that is being conveyed, the drying device being disposed at a location on the downstream side of the recording head in the conveyance path.

8. A recording device comprising:

the drying device according to claim 4; and a recording head configured to carry out recording on the recording medium partway along the conveyance path of the recording medium that is being conveyed, the drying device being disposed at a location on the downstream side of the recording head in the conveyance path.

9. The drying device according to claim 1, wherein the extended surface portion is located a first distance away from the front face of the recording medium in a direction that is perpendicular to the conveyance direction, and the first distance is same as a second distance between the discharge port and the front face of the recording medium in the direction that is perpendicular to the conveyance direction.

10. A recording device comprising:

the drying device according to claim 9; and a recording head configured to carry out recording on the recording medium partway along the conveyance path of the recording medium that is being conveyed, the drying device being disposed at a location on the downstream side of the recording head in the conveyance path.

* * * * *